US010370166B2

(12) United States Patent
Moretti

(10) Patent No.: US 10,370,166 B2
(45) Date of Patent: Aug. 6, 2019

(54) FLUID SUBSTANCE CONTAINER

(71) Applicant: LUMSON S.p.A., Capergnanica (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 0 days.

(21) Appl. No.: 15/997,813

(22) Filed: Jun. 5, 2018

(65) Prior Publication Data

US 2018/0354697 A1 Dec. 13, 2018

(30) Foreign Application Priority Data

Jun. 8, 2017 (IT) ..... 102017000063184

(51) Int. Cl.

| | |
|---|---|
| ***B65D 75/58*** | (2006.01) |
| ***B05B 11/00*** | (2006.01) |
| ***B65B 3/04*** | (2006.01) |
| ***B65B 3/02*** | (2006.01) |
| ***B65B 3/12*** | (2006.01) |

(52) U.S. Cl.

CPC .... *B65D 75/5883* (2013.01); *B05B 11/00412* (2018.08); *B05B 11/3047* (2013.01); *B05B 11/0097* (2013.01); *B05B 11/3011* (2013.01); *B05B 11/3016* (2013.01); *B05B 11/3066* (2013.01); *B65B 3/02* (2013.01); *B65B 3/045* (2013.01); *B65B 3/12* (2013.01); *B65D 75/5866* (2013.01)

(58) Field of Classification Search

CPC ..... B65D 75/5883; B05B 11/00412; B05B 11/3011; B05B 11/3016

USPC ..... 222/96, 107, 321.1, 321.7, 321.9, 566

See application file for complete search history.

(56) References Cited

U.S. PATENT DOCUMENTS 5,343,901 A * 9/1994 Meshberg ..... B05B 11/0037 141/2
5,873,491 A * 2/1999 Garcia ..... B05B 11/3001 222/95
6,050,451 A * 4/2000 Hess, III ..... B65D 5/746 105/107

(Continued)

FOREIGN PATENT DOCUMENTS

FR 2987609 A1 9/2013
FR 3037260 A1 12/2016

(Continued)

OTHER PUBLICATIONS

Search Report and Written Opinion dated Feb. 27, 2018 for Italian patent application No. 2017000063184.

*Primary Examiner* — Vishal Pancholi
(74) *Attorney, Agent, or Firm* — Vorys, Sater, Seymour and Pease LLP

(57) ABSTRACT

A fluid substance container including a collar featuring a passage and a pair of laminated film sheets heat-welded along perimetral welding lines so as to form a bag, the pair of sheets also being heat-welded to the collar so that the passage in the collar provides access to interior of the bag; the collar features a cup-shaped part in which the passage is formed, there being a sealing lip extending from a bottom of the cup-shaped part, the sealing lip being formed integrally with the collar and intended to cooperate in an air-tight manner with an outer surface of the body of a hermetic pump which may be housed, at least partially, in the collar.

12 Claims, 5 Drawing Sheets

(56) References Cited

U.S. PATENT DOCUMENTS

| | | | | |
|---|---|---|---|---|
| 6,241,132 | B1 * | 6/2001 | Morrison | B65D 47/10 222/541.6 |
| 6,273,307 | B1 * | 8/2001 | Gross | B65D 75/5883 220/613 |
| 7,201,296 | B2 | 4/2007 | Graf | |
| 2004/0256414 | A1 * | 12/2004 | Graf | B05B 11/3016 222/321.1 |
| 2005/0061831 | A1 * | 3/2005 | Brown | A45F 3/20 222/107 |
| 2007/0047851 | A1 * | 3/2007 | Sato | B29C 45/14336 383/104 |
| 2008/0078781 | A1 * | 4/2008 | Py | B65D 75/5866 222/96 |
| 2008/0314475 | A1 * | 12/2008 | Fransen | B65D 83/62 141/20 |
| 2009/0139993 | A1 * | 6/2009 | Last | B29C 66/242 220/601 |
| 2011/0007987 | A1 * | 1/2011 | Davideit | B65D 83/425 383/42 |
| 2015/0014990 | A1 | 1/2015 | Bodet et al. | |
| 2017/0129680 | A1 | 5/2017 | Murray | |
| 2018/0353983 | A1 | 12/2018 | Moretti | |

FOREIGN PATENT DOCUMENTS

| | | | |
|---|---|---|---|
| WO | 2008030623 | A2 | 3/2008 |
| WO | 2013074953 | A1 | 5/2013 |
| WO | 2017060631 | A1 | 4/2017 |

* cited by examiner

FLUID SUBSTANCE CONTAINER

CROSS REFERENCE TO RELATED APPLICATION

This claims the benefit of Italian patent application no. 102017000063184, filed Jun. 8, 2017, hereby incorporated by reference in its entirety.

FIELD OF THE INVENTION

The present invention relates to a fluid substance container.

In particular, it refers to a container of the deformable bag type, produced by coupling two perimetrically welded laminated film sheets.

In particular, it refers to a container of the deformable bag type, intended to be coupled to a hermetically sealed pump of the airless type.

BACKGROUND ART

Commonly known laminated film bags, to be duly filled and subsequently fastened to a manual pump, require an essentially cylindrical collar made of a rigid material, which is secured permanently (welded) to the said bag.

The welding zone between the laminated film sheets forming the bag and the collar is particularly critical and irregularities are often created in this zone, which allow air to enter the bag, thereby contaminating the product contained therein and compromising the seal of the bag/pump system.

SUMMARY OF INVENTION

The object of the present invention is to provide a fluid substance container which is improved compared with the known art.

A further object of the invention is to provide a container which minimises sealing problems, particularly in the welding zone between a pump coupling collar and the laminated film sheets which form the bag.

This and other objects are achieved by means of a fluid substance container produced according to the technical teachings of the claims annexed hereto.

Advantageously, the present invention allows the manual pump to be sealed to the bag effectively.

Moreover, advantageously, the present invention facilitates automation of the bag and collar welding operations.

BRIEF DESCRIPTION OF THE FIGURES

Further characteristics and advantages of the invention will become clearer in the description of a preferred but not exclusive embodiment of the container, illustrated—by way of a non-limiting example—in the drawings annexed hereto, in which.

DETAILED DESCRIPTION OF THE INVENTION

With reference to the figures stated, reference number 1 is used to denote, as a whole, a fluid substance container.

In the present wording, the term "fluid substance" refers to a substance with a liquid or creamy consistency, which may be, for example, a cosmetic cream, a perfume, a medicine, a gel, a lacquer, a hair product, etc.

Figure 11:
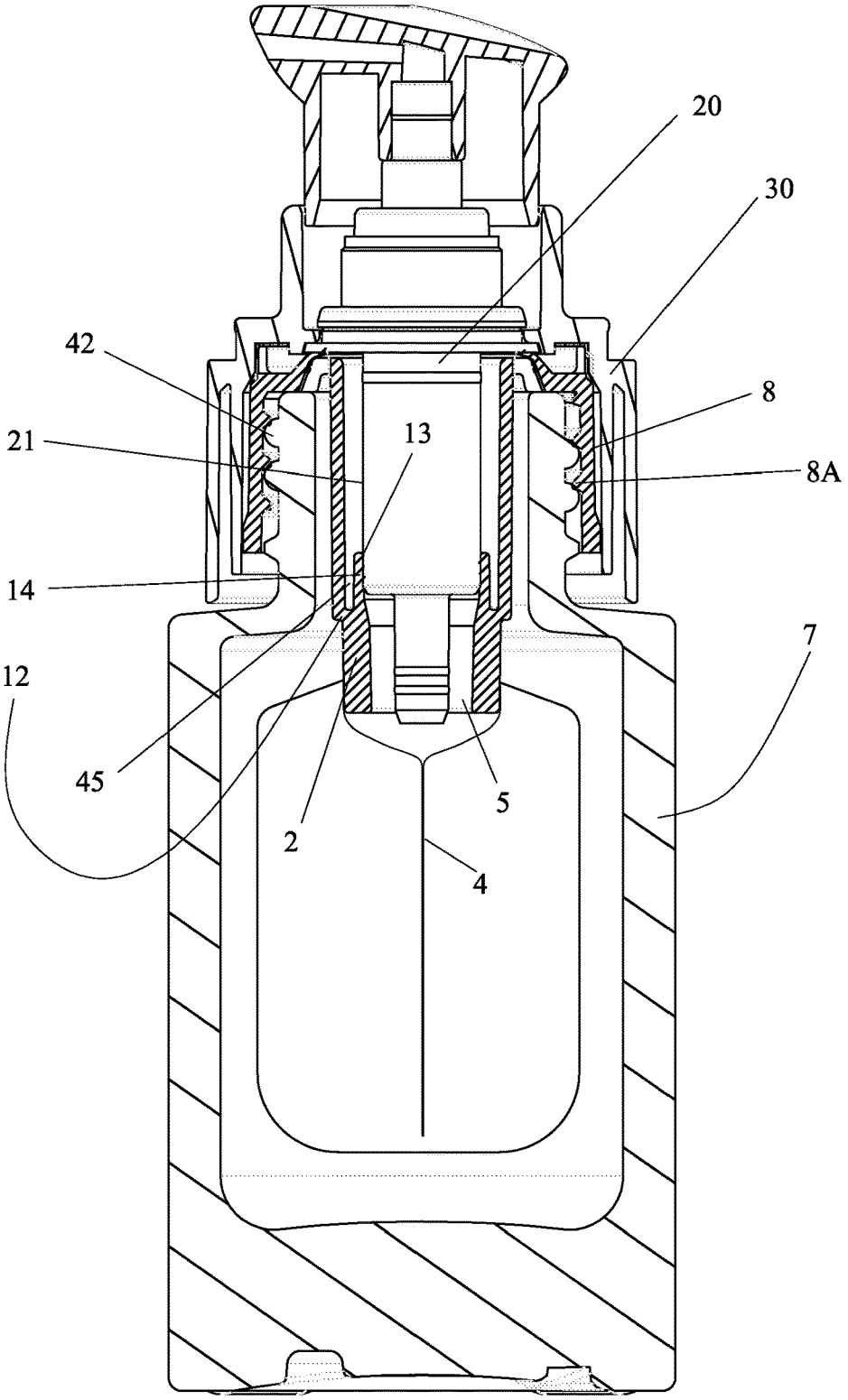
FIG. 11 is a section taken along line XI-XI of FIG. 7, when the container is housed inside an outer container and coupled to a manual dispensing pump.

The container 1 is intended, during the end use, to be housed inside an outer container 7, for example, a container made of plastic or glass, such as the container shown in the section in FIG. 11.

The container 1 comprises a collar 2 having a passage 5 (for example a cylindrical hole) and a pair 3A, 3B of laminated film sheets thermally bonded along perimetral welding lines S1 so as to form a bag 4.

Figure 2:
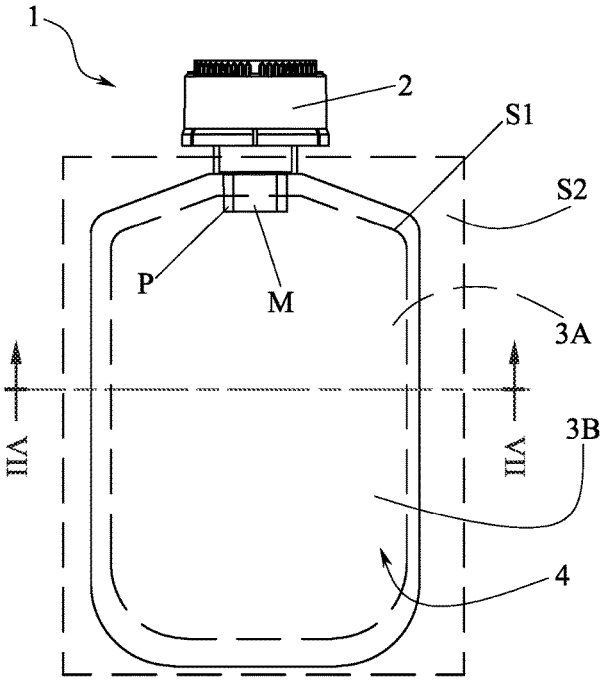
FIG. 2 is a front plan view of the container according to the present invention, when empty.
Figure 3:
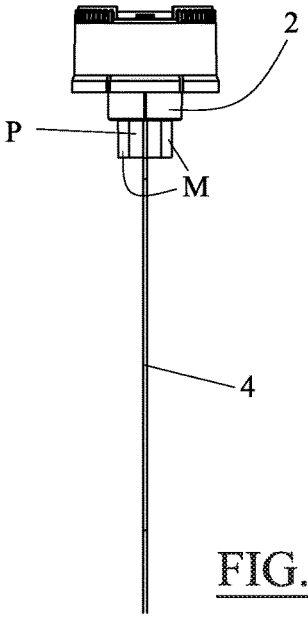
FIG. 3 is a side view of the container in FIG. 2.
Figure 4:
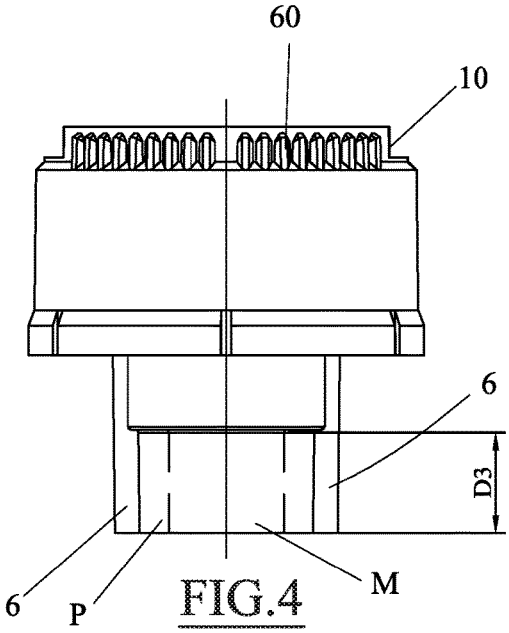
FIG. 4 is a front view of the collar in FIG. 1.
Figure 5:
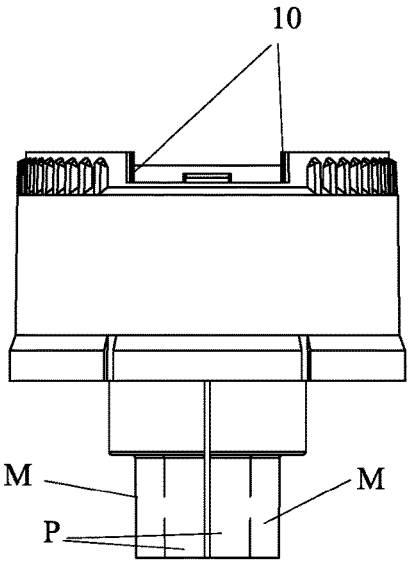
FIG. 5 is a side view of the collar in FIG. 1.
Figure 6:
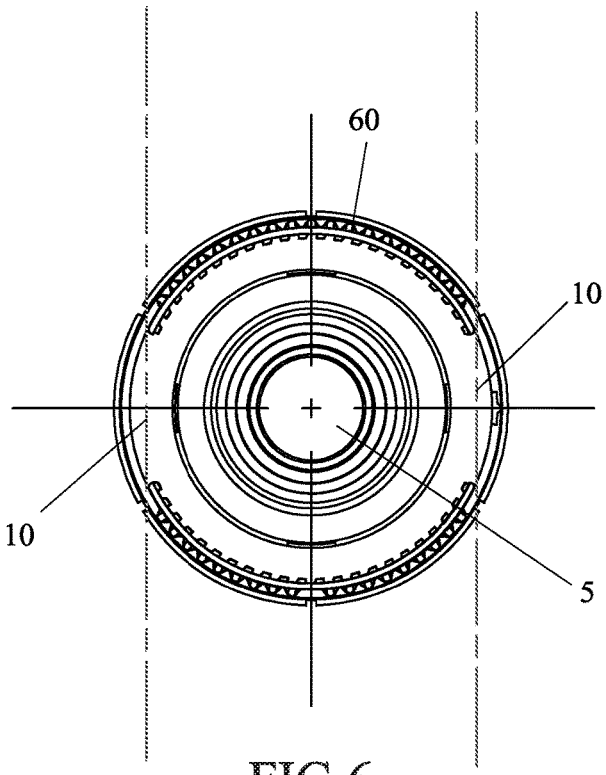
FIG. 6 is a plan view of the collar in FIG. 1.

The pair of sheets 3A, 3B is also thermally bonded, in a sealed manner, to the outer surface of the collar 2, so that the passage 5 in the collar 2 provides access to the bag 4, which is shown in the entirety thereof in the views in FIGS. 2 and 3.

The laminated film sheets or films may be made, for example, of the following materials: PA/AL/PE, PA/PET/PE, PE, AL/PE, PA/AL/PP, PA/PET/PP, PE/EVOH/PE, PE/EVOH/PP, PE/PA/EVOH/PE.

The sheets are thin enough to maintain a fair degree of deformability and be able to swell once the bag is filled with the fluid substance.

The collar may be made of a more rigid material than that of the laminated film sheets. In the present wording, the term 'rigid' means a material which maintains dimensional stability at room temperature, even when subjected to the normal stresses applied thereto during use of the container 1.

By way of example, materials suitable for the production of the collar 2 include: PE, HDPE, LDPE, PP, PET, PETG, PA.

Figure 1:
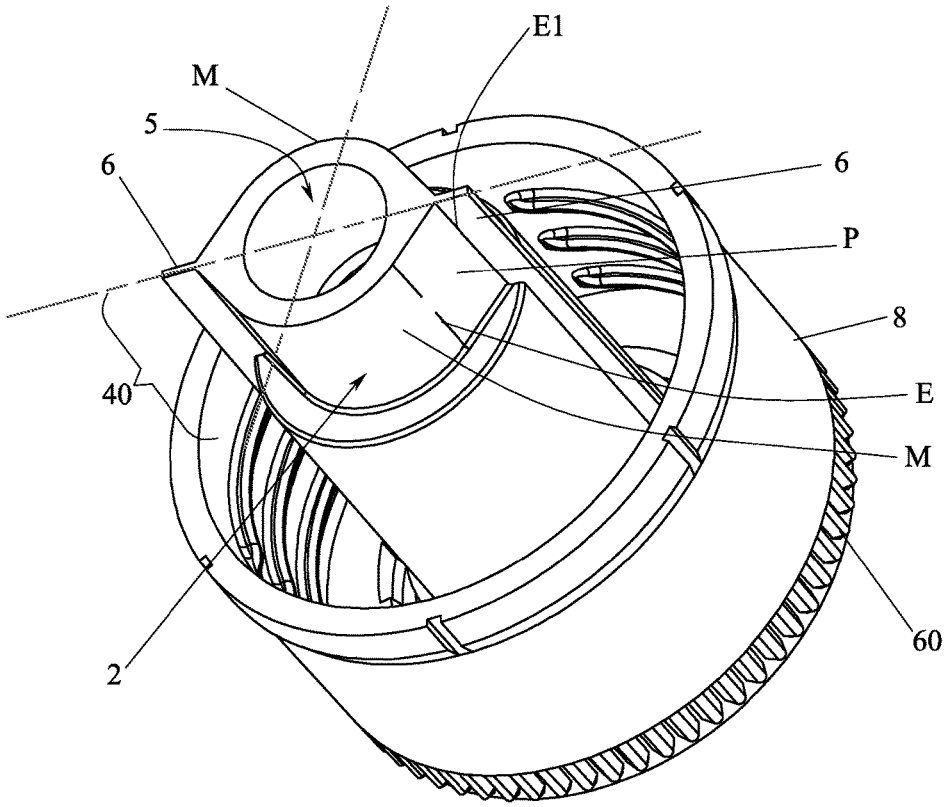
FIG. 1 is a perspective view of a container collar according to the present invention.
Figure 7:
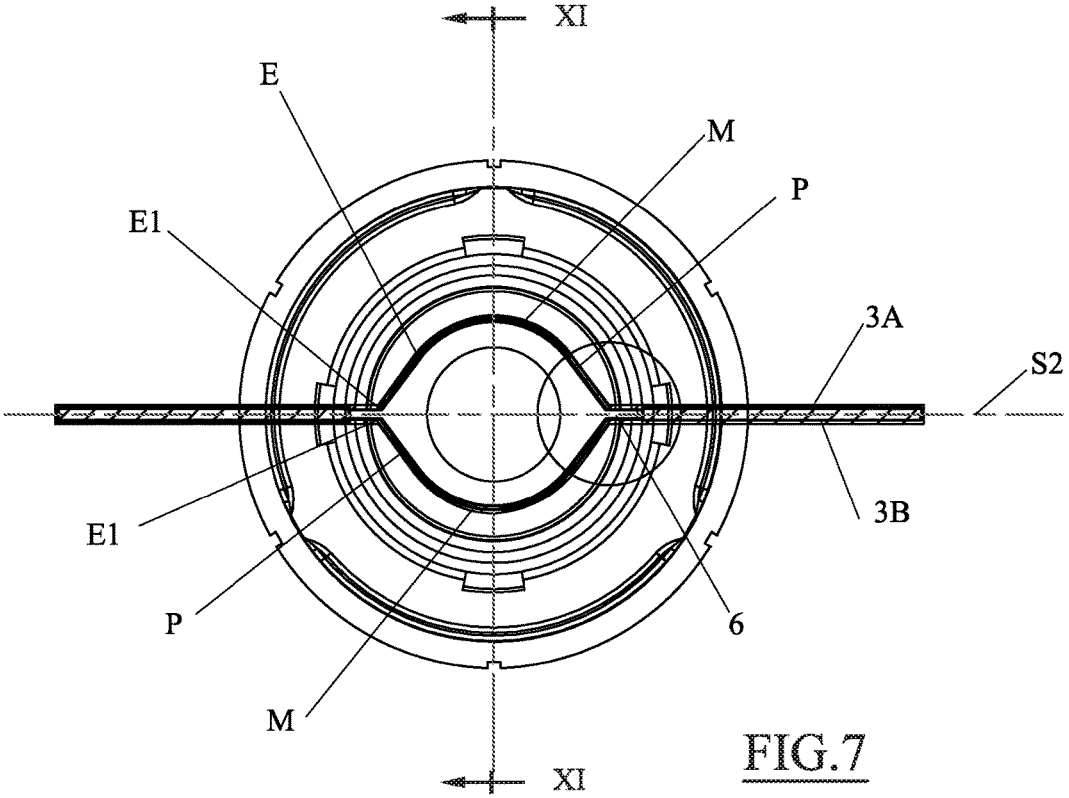
FIG. 7 is a simplified section taken along line VII-VII of FIG. 2.
Figure 8:
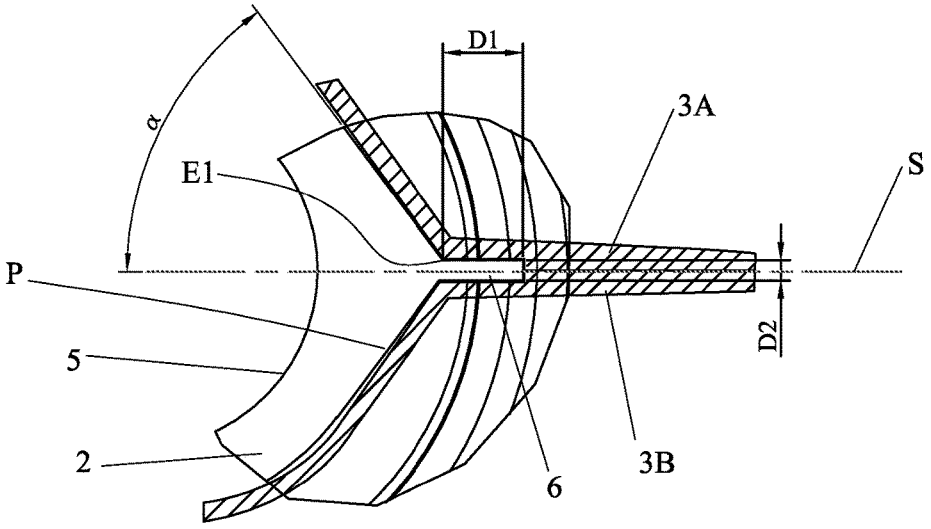
FIG. 8 is an enlarged, simplified view of the part circled in FIG. 7.

As can be seen in the sections in FIGS. 7 and 8, as well as in the perspective view in FIG. 1, the outer surface of the collar 2, in a welding zone 40 including a portion of each of the sheets 3A, 3B has, seen in section, an oblong conformation with two tapered ends aligned along at least one axis S along which the pair 3A, 3B of laminated film sheets are welded together.

The "oblong" conformation of the welding zone may also comprise a fin 6, projecting from each of the tapered ends; each fin 6 is integrally formed with the collar 2 and facilitates the interconnection of the pair 3A, 3B of laminated film sheets. Each fin may extend from the collar 2 along said axis S where the pair 3A, 3B of sheets are welded together.

As can easily be seen, the welding zone 40 on the body 2, seen in section, may be symmetrical, at least with respect to the said welding axis S, but preferably also with respect to a central axis C which is perpendicular to the axis S along which the sheets forming the bag are welded together.

In practice, a plane S2 (see FIG. 2) passes through the axis S, the two sheets 3A and 3B forming the bag being welded together along the axis S1 running along the plane S2. Only the welds sealing the bags to a part of the outer surface of the body 2 are outer to the plane.

The welding zone 40, seen in section, is formed of a first A and a second half B, which may be specular with respect to the welding axis S. Each half may feature a middle part M having the form of a circumferential arc; from each of the ends E of the circumferential arc, a preferably rectilinear segment P (endowed with an end E1 proximal to the welding axis S) may extend towards the said welding axis S.

Each fin 6 may extend from the end proximal to each segment's welding axis.

Each fin 6 may have a width D2 of between 0.5 mm and 3 mm, preferably of 1 mm, and may have a length D1 of between 1 mm and 5 mm, preferably of 2 mm.

The welding zone S may have a height D3 of between 5 mm and 10 mm, preferably of 7 mm.

The inclination a (FIG. 8) of the segments P with respect to the axis S may be between 30° and 60°, preferably 45°.

In section, the form of the fin may be similar to that of a rectangle extending mainly lengthways. Such form, however, is noticeable only before the collar 2 is welded to the laminated film sheets 3A, 3B, or in sections taken along the fin in parts not concerned by the welding. Indeed, during the hot welding operation, the fin softens and deforms, becoming integral with the said welding, thereby ensuring a perfect seal (even when depressurized) of the bag formed from the sheets.

As already mentioned, the container 1 is housed in an outer container 7 during use. One possible configuration of the collar 2 features the presence of a ring nut 8 fastening the said collar to an outer container 7, in which the bag 4 may be housed.

The ring nut may feature a thread 8A which couples with a counterthread 42 featured on a neck of the outer container 7, or other means of securing thereto, such as a snap coupling.

As an alternative to the ring nut, it is possible for the body 2 to feature a simple flange, resting on the upper end of the mouth of the outer container 7. The flange is then secured to the outer container, for example, by means of a conventional operation with a cold crimping system.

The flange may also rest on an intermediate element made of a plastic material, coupled, for example, by screwing onto the neck, and sandwiched by a pump fastening element, which is fastened to the intermediate element in a known manner.

In order to couple, in a sealed manner, the inside of the bag 4 to the hermetic manual pump 20, the collar 2 may have a cup-shaped part where the pump body may be housed. In such cup-shaped part, where the passage 5 is formed in the bottom 12, a sealing system may be present between the collar 2 and the pump.

For example, a sealing lip or collar 13 (integrally formed with the collar 2) may extend from the bottom 12 of the said cup-shaped part, the said sealing lip or collar being intended to cooperate in an air-tight manner with an outer surface 21 of the body of the pump 20.

The sealing lip may be positioned on a tubular element 14 (advantageously at a free end thereof) extending from the bottom 12 of the cup-shaped body and spaced apart from an inner lateral surface of the cup-like body proximal to the bottom 12 thereof, so as to form a gap 45 which insulates the lip 13, thermally and mechanically, from stresses exerted on the welding zone between the sheets 3A, 3B and the collar 2.

The presence of the tubular element 14 (which is also integrally formed with the collar 2) and the gap 45 is important. Indeed, during the operation to weld the collar 2 to the sheets 3A and 3B, the bottom of the cup (i.e. the welding zone 40) is subjected to considerable stress both from a thermal point of view (due to the welding operations) and from a mechanical point of view (a gripper is used that tightens the sheets around the collar 2).

The tubular element 14 and the gap 45 prevent the sealing lip 13 from undergoing deformation due to the mechanical and thermal stresses which would deform it and compromise the hold on the pump surface, keeping the said lip suitably spaced apart from the welding zone 40.

The presence of the gap 45 is particularly important when fins 6 are present. In fact, to also melt the fins 6 during their welding with the laminated film sheets in order to grant a perfect sealing, a great amount of heat is necessary. In this condition, the gap 45 allows to isolate the sealing lip 13 from the heat used to perform welding, preserving the exact shape of the sealing lip 13 that is not deformed during the welding process.

Figure 12:
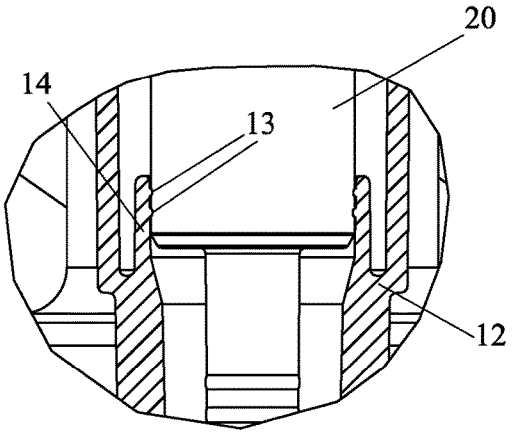
FIG. 12 is an enlargement of a part of the section in FIG. 11.

In the present embodiment, as can be seen in FIG. 12, there are two sealing lips 13 at two different diameters of the tubular element.

In order to allow automatic welding between the collar and the two sheets of laminated film, the collar 2 features at least one pair of surfaces 10 for positioning the collar 2, intended for an automatic operation to weld the sheets 3A, 3B to the collar 2.

In one possible configuration, the collar 2 comprises an end provided with a crown equipped with torsional coupling teeth with an element 30 for fastening the pump 20 to at least the collar 2. In this configuration, the pair of surfaces is made from parallel surfaces 10 (where part of the crown of teeth is not present) provided near the said end of the collar 2.

Figure 9:
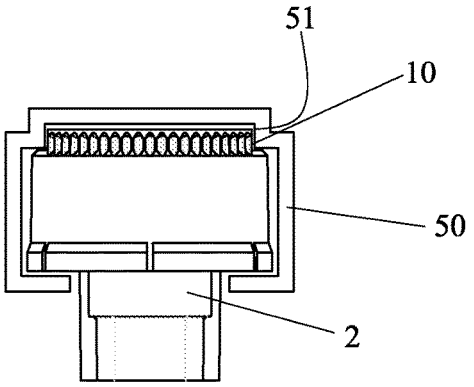
FIG. 9 is a front view of a collar engaged with a positioning guide of an automatic machine, in a prior step to an operation to weld the collar to the laminated film sheets which form the bag.

In this way, the collar 2 may be positioned prior to welding by means of a mechanical guide 50 (FIG. 9) essentially formed from a section bar featuring a narrowing 51 positioned in a zone intended to couple with the upper end of the collar.

The cooperation of the narrowing 51 with the surfaces 10 allows the oblong portion of the collar 2 to align with the welding grippers, which act on the sheets 3A and 3B and on the collar welding zone 40 (optionally provided with fins).

It should be noted that the positioning between the plane formed by the surfaces and the welding plane is fixed, and in this case, the plane of the surfaces 10 is perpendicular to the welding plane S2.

Figure 10:
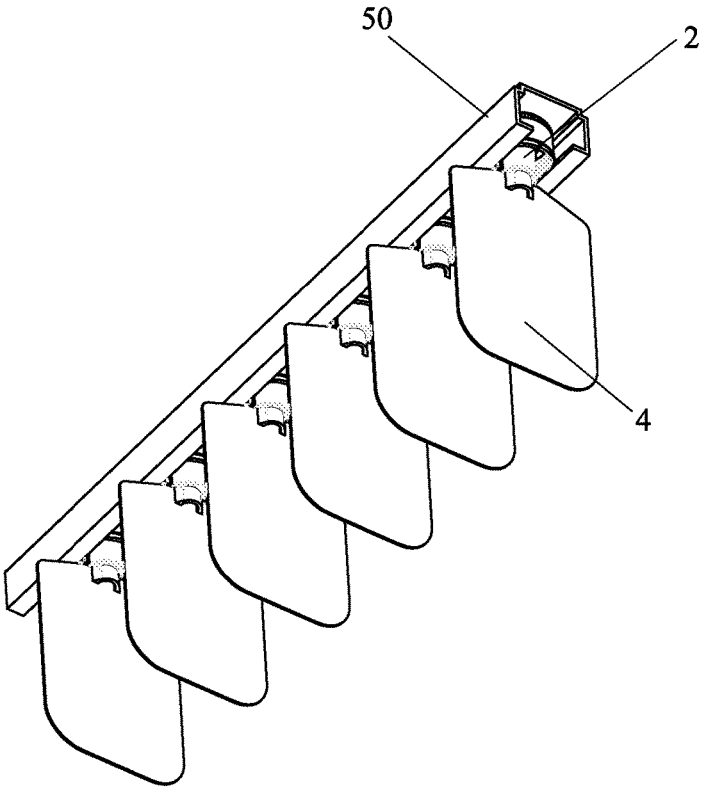
FIG. 10 shows a perspective view of a series of containers according to FIG. 2, supported by the guide in FIG. 9.

FIG. 10 shows a plurality of containers 1 already formed as a result of the welding together of the collar and sheets.

The operation envisaged in the present invention is apparent the description above and is essentially as follows.

The container 1, advantageously produced in an automatic manner, is provided empty and with the bag partially rolled so as to be inserted into the outer container 7. Once the insertion operation is complete, the collar ring nut 8 is tightened onto the outer container and the bag is filled and, through the weight of the fluid contained therein, 'opens' and deforms.

It should be noted that, between the ring nut 8 and the collar 2, there is an air passage, which allows air to flow freely into the outer container 7, externally to the bag 4.

Once the filling operations are complete, the hermetic manual pump 20 is inserted into the cup-shaped portion of the collar. The lip 13 engages, in a sealed manner, with the outer surface 21 of the body of the pump 20, thereby sealing off the interior of the bag, which is connected with a dip tube of the pump 20. Subsequently, the fastening element 30 is fitted onto the pump, which engages (for example, by means of pressure) with the collar 2, thereby sandwiching a flange of the pump between the collar 2 and the fastening element.

Between the collar 2 and the fastening element 30, there is a torsional coupling featured (for example, the aforesaid teeth 60, which do not therefore require alignment of the fastening element with the collar). Once the product inside the bag has been completely dispensed by the pump (and therefore the bag is very compressed, practically crushed in on itself due to the depressurisation therewithin), by unscrewing the fastening element, the collar, the bag, and the pump are removed contemporaneously and may therefore be easily separated from the external container 7, for efficient disposal thereof, sorted according to waste type.

Various embodiments of the innovation have been disclosed herein, but further embodiments may also be conceived using the same innovative concept.

The invention claimed is:

1. A container of a fluid, comprising:

a collar having a passage, and a pair of laminated film sheets thermally bonded along perimetral welding lines so as to form a bag, the pair of sheets being also thermally welded to the collar at a welding zone so that the passage of the collar defines an access inside the bag;

wherein the collar includes a cup-shaped part having a bottom through which said passage extends, the bottom of the cup-shaped part being arranged proximate an upper end of the welding zone;

a sealing lip extending from the bottom of said cup-shaped part, the sealing lip being integrally formed with the collar, the sealing lip cooperating in an air-tight manner with an outer surface of the pump body of an airless pump that may be housed at least partially in the cup-shaped part;

wherein the outer surface of the collar, in the welding zone with each of the sheets having, in section, an oblong conformation with two tapered ends aligned along at least one welding axis where the pair of sheets are welded together.

2. The container according to claim 1, wherein the sealing lip is positioned on an inner surface a tubular element extending from the bottom of the cup-shaped body, the lip being spaced from an inner lateral surface of the cup shaped body near its bottom, the tubular element being disposed so as to form a cavity which isolates the lip thermally and mechanically from the forces applied to the welding zone during the welding between the collar and the sheets.

3. The container according to claim 2, wherein two said sealing lips are provided in the tubular element.

4. The container according to claim 2, wherein from each of the tapered ends, a fin protrudes integrally formed with a collar, the fin helping the interconnection between a body of the collar and the pair of laminated film sheets, each fin extending from the collar along said welding axis where the pair of sheets are welded together.

5. The container according to claim 1, wherein the welding zone, viewed in section, is symmetrical at least with respect to said welding axis.

6. The container according to claim 5, wherein the welding zone, seen in section, is formed by a first half and a second half specular with respect to the welding axis, each half having a middle part shaped as a circumferential arc, from each end of the circumferential arc extending towards said welding axis a straight segment having an end proximal to the welding axis.

7. The container according to claim 6, wherein the fin extends from the end proximal to the welding axis of each of the segments.

8. The container according to claim 1, wherein the collar comprises a fastening ring nut to an outer container in which the bag may be inserted, and or wherein the collar comprises an end having a torsional coupling tooth crown with an element for fixing a pump at least to the collar, and where pair of orientation surfaces is made by parallel bushes that interrupt the crown and obtained near said end of the collar.

9. The container according to claim 1, wherein the collar has at least a pair orientation surfaces to align the collar prior to an automatic welding of the sheets to the collar.

10. The container according to claim 1, wherein the sealing lip is positioned on an inner surface a tubular element extending from the bottom of the cup-shaped body.

11. The container according to claim 1, wherein the sealing lip being spaced from an inner lateral surface of the cup shaped body near its bottom, the tubular element being disposed so as to form a cavity which isolates the lip thermally and mechanically from the forces applied to the welding zone during the welding between the collar and the sheets.

12. The container according to claim 1, wherein at least a portion of the inner sidewalls of the sealing lip is tapered to flare away from the bottom of said cup-shaped part.

* * * * *